US008186276B1

(12) United States Patent
Olden et al.

(10) Patent No.: US 8,186,276 B1
(45) Date of Patent: May 29, 2012

(54) ENTRAPMENT SYSTEMS AND APPARATUSES FOR CONTAINING PROJECTILES FROM AN EXPLOSION

(75) Inventors: Thomas A. Olden, Tucson, AZ (US); Robert P. Johnson, Tucson, AZ (US); Charles A. Howland, Temple, NH (US)

(73) Assignees: Raytheon Company, Waltham, MA (US); Warwick Mills, Inc., New Ipswich, NH (US)

( * ) Notice: Subject to any disclaimer, the term of this patent is extended or adjusted under 35 U.S.C. 154(b) by 262 days.

(21) Appl. No.: 12/556,311

(22) Filed: Sep. 9, 2009

Related U.S. Application Data

(60) Provisional application No. 61/161,256, filed on Mar. 18, 2009.

(51) Int. Cl.
*F42B 12/68* (2006.01)

(52) U.S. Cl. ..... 102/504; 102/502

(58) Field of Classification Search ..... 102/502, 102/504
See application file for complete search history.

(56) References Cited

U.S. PATENT DOCUMENTS

| | | | | |
|---|---|---|---|---|
| 2,373,364 | A | 4/1945 | Wellcome | |
| 3,648,613 | A | 3/1972 | Cunn | |
| 3,801,416 | A | 4/1974 | Gulbierz | |
| 3,814,016 | A | 6/1974 | Leach et al. | |
| 4,794,235 | A | 12/1988 | Burke et al. | |
| 5,326,101 | A | 7/1994 | Fay | |
| 5,750,918 | A * | 5/1998 | Mangolds et al. | 102/502 |
| 5,864,767 | A | 1/1999 | Drumgoole et al. | |
| 6,323,145 | B1 | 11/2001 | Popper et al. | |
| 6,381,894 | B1 | 5/2002 | Murphy | |
| 6,568,118 | B1 | 5/2003 | Teetzel | |
| 6,626,077 | B1 * | 9/2003 | Gilbert | 89/1.11 |
| 6,854,374 | B1 | 2/2005 | Breazeale | |
| 6,904,838 | B1 | 6/2005 | Dindl | |
| 7,500,423 | B2 | 3/2009 | Strand | |
| 7,743,709 | B2 | 6/2010 | Kolnik et al. | |
| 2003/0010185 | A1 | 1/2003 | O'Dwyer | |
| 2007/0117483 | A1 | 5/2007 | Bhatnagar et al. | |
| 2007/0169616 | A1 | 7/2007 | Vickroy | |
| 2008/0110986 | A1 | 5/2008 | Quinn | |
| 2008/0127598 | A1 * | 6/2008 | Kallstrom | 52/656.7 |
| 2009/0212108 | A1 | 8/2009 | Rothe et al. | |
| 2009/0266226 | A1 * | 10/2009 | Beach et al. | 89/36.02 |

(Continued)

FOREIGN PATENT DOCUMENTS

WO WO-2010107469 9/2010

(Continued)

OTHER PUBLICATIONS

"Application Serial No. PCT/US2010/02849, Written Opinion mailed Aug. 5, 2011", 7 pgs.

(Continued)

*Primary Examiner* — Stephen M Johnson
(74) *Attorney, Agent, or Firm* — Schwegman, Lundberg & Woessner, P.A.

(57) ABSTRACT

Embodiments of entrapment systems and apparatuses are generally described herein. Other embodiments may be described and claimed. In one embodiment, an entrapment apparatus is provided. This entrapment apparatus comprises a casing and a piece of multilayered fabric packed into the casing. The piece of multilayered fabric, when deployed, is configured to wrap around a person having an explosive device and configured to contain packed metal projectiles from an explosion of the explosive device.

19 Claims, 7 Drawing Sheets

U.S. PATENT DOCUMENTS

| | | | | |
|---|---|---|---|---|
| 2009/0266892 | A1 | 10/2009 | Windauer et al. | |
| 2011/0101097 | A1 | 5/2011 | Olden et al. | |
| 2011/0129657 | A1 * | 6/2011 | Clough | 428/219 |

FOREIGN PATENT DOCUMENTS

| | | | |
|---|---|---|---|
| WO | WO-2011096916 | A2 | 8/2011 |
| WO | WO-2011096916 | A3 | 8/2011 |

OTHER PUBLICATIONS

"International Application Serial No. PCT/US2010/000629, International Preliminary Report on Patentability mailed Sep. 29, 2011", 10 pgs.

"International Application Serial No. PCT/US2010/02849, International Search Report mailed Aug. 5, 2011", 2 pgs.

"International Serial No. PCT/US2010/000629, Search Report mailed May 13, 2010", 5 pgs.

"International Application Serial No. PCT/US2010/000629, Written Opinion mailed May 13, 2010", 10 pgs.

"International Application Serial No. PCT/US2010/000629, Search Report mailed May 13, 2010", 5 pgs.

"U.S. Appl. No. 12/610,498 , Response filed Jan. 31, 2012 to Non Final Office Action mailed Nov. 17, 2011", 11 pgs.

"U.S. Appl. No. 12/610,498, Non Final Office Action mailed Nov. 7, 2011", 8 pgs.

* cited by examiner

ENTRAPMENT SYSTEMS AND APPARATUSES FOR CONTAINING PROJECTILES FROM AN EXPLOSION

CROSS-REFERENCES TO RELATED APPLICATIONS

This application claims the benefit of U.S. Provisional Application No. 61/161,256, filed Mar. 18, 2009, the disclosure of which is incorporated herein by reference.

FIELD

The present disclosure relates generally to explosives containment. In an embodiment, the disclosure relates to entrapment systems and apparatuses for containing projectiles from an explosion.

BACKGROUND

A type of suicide bombing involves a person carrying an explosive device on foot and exploding the explosive device to inflict casualties. As an example, a suicide bomber may carry out a suicide attack on foot by carrying an explosive device in the form of an explosive belt or satchel charge packed with metal projectiles and exploding the explosive device in a crowded place to inflict a large number of casualties.

Existing methods to deal with a suicide bomber, if spotted, are to shoot and/or physically restrain him. However, shooting or restraining the suicide bomber may not prevent the explosive device from being detonated, as the explosive device may be triggered remotely by another person or the suicide bomber may still be able to trigger the explosive device when wounded or restrained.

SUMMARY

In an embodiment, an entrapment system is provided for containing packed metal projectiles from an explosion of an explosive device. The entrapment system comprises a sabot and a sighting device coupled to the sabot. The sighting device is configured to align the sabot relative to a person having the explosive device. The entrapment system also includes an entrapment apparatus coupled to the sabot. Here, the entrapment apparatus is configured to be ejected from the sabot and comprises a casing and a piece of multilayered fabric packed into the casing. This piece of multilayered fabric, when deployed, is configured to wrap around the person having an explosive device and to contain the packed metal projectiles from the explosion of the explosive device.

In another embodiment, an entrapment apparatus is provided. This entrapment apparatus comprises a casing and a piece of multilayered fabric packed into the casing. The piece of multilayered fabric, when deployed, is configured to wrap around a person having an explosive device and configured to contain packed metal projectiles from an explosion of the explosive device.

In yet another embodiment, another entrapment apparatus is provided. This entrapment apparatus comprises a casing, a pyrotechnic device coupled to the casing, a proximity sensor configured to detect a presence of a person, a circuitry coupled to the pyrotechnic device and the proximity sensor, and a piece of multilayered fabric packed into the casing. The circuitry is configured to trigger the pyrotechnic device to explode based on a detection of the presence of the person, and the explosion of the pyrotechnic device is configured to break apart the casing. The piece of multilayered fabric is a mesh and includes an air beam structure that is configured to stretch out the piece of multilayered fabric after the casing is broken apart. Here, the piece of multilayered fabric, when stretched out, is configured to wrap around the person having an explosive device and to contain packed metal projectiles from an explosion of the explosive device.

BRIEF DESCRIPTION OF DRAWINGS

The present disclosure is illustrated by way of example and not limitation in the figures of the accompanying drawings, in which like references indicate similar elements and in which.

DETAILED DESCRIPTION

The following description and the drawings illustrate specific embodiments of the invention sufficiently to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. Embodiments of the invention set forth in the claims encompass all available equivalents of those claims. Embodiments of the invention may be referred to, individually or collectively, herein by the term "invention" merely for convenience and without intending to limit the scope of this application to any single invention or inventive concept if more than one is in fact disclosed.

Figure 1:
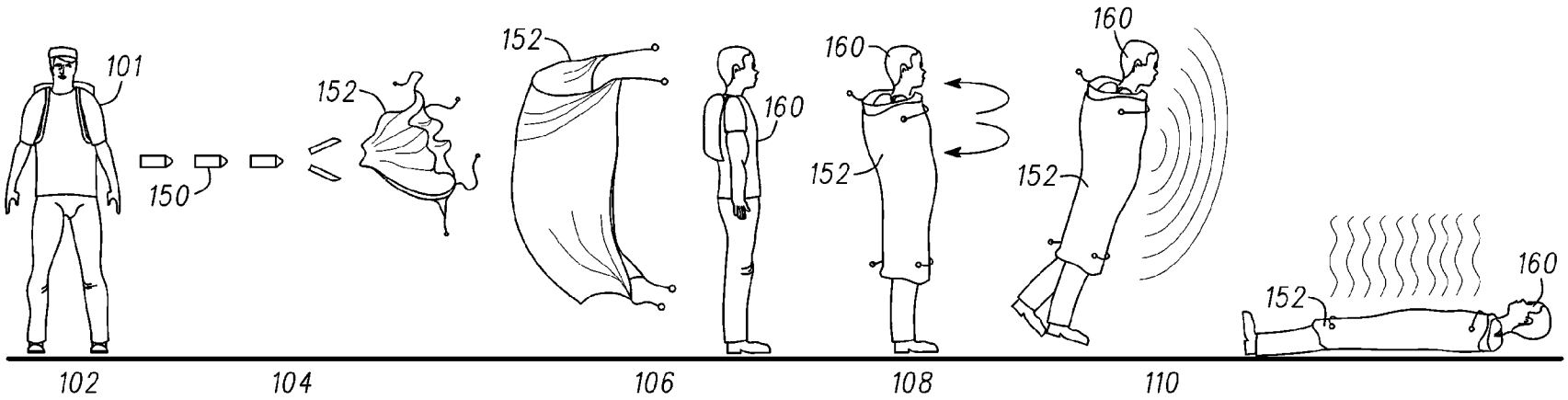
FIG. 1 depicts a time-elapsed diagram illustrating a deployment of an entrapment apparatus, according to one embodiment of the invention, configured to contain projectiles from an explosion of an explosive device carried by a person.

FIG. 1 depicts a time-elapsed diagram illustrating a deployment of an entrapment apparatus 150, according to one embodiment of the invention, configured to contain projectiles from an explosion of an explosive device carried by a person 160. As depicted at 102, another person 101 carries an entrapment system for launching an entrapment apparatus 150, which is included in a rucksack. In this example, this other person 101 identifies the person 160 having or carrying an explosive device, and aims the entrapment apparatus 150 at the person 160. While the person 160 is within the line of sight, this other person 101 launches the entrapment apparatus 150 towards the person 160.

In one embodiment, the entrapment apparatus 150 includes a casing and a piece of multilayered fabric 152 packed into the casing. After the entrapment apparatus 150 is launched, as depicted at 104, the casing of the entrapment apparatus 150 breaks apart at a certain distance from the person 160 to release and deploy the piece of multilayered fabric 152. As depicted at 106, once deployed, the piece of multilayered fabric 152 is configured to unfold or spread out and, as depicted at 108, to wrap around the person 160 having the explosive device. When wrapped around the person 160, the piece of multilayered fabric 152 can contain projectiles from an explosion of the explosive device, as depicted at 110. The projectiles may include a variety of objects propelled from an explosion. In one embodiment, the projectiles may be packed metal projectiles that are metallic objects bundled or tied together with the explosive device. Examples of packed metal projectiles include nails, nuts, bearings, and other packed metal projectiles. To inflict a large number of casualties, the explosive device carried by the person 160 may be designed to project the projectiles toward a crowd of people. It should be noted that the projection of the projectiles from an explosion, and not the blast wave from the explosion, that usually inflict the most casualties.

Still referring to 110, the piece of multilayered fabric 152 when wrapped around the person 160 contains the projectiles (and a portion of the blast wave) projected from the explosion and, as a result, minimizes casualties. In addition to containing projectiles from the explosion, the entrapment apparatus 150 may further immobilize the person 160 and therefore, provide a nonlethal alternative to neutralize the person 160.

Figure 2:
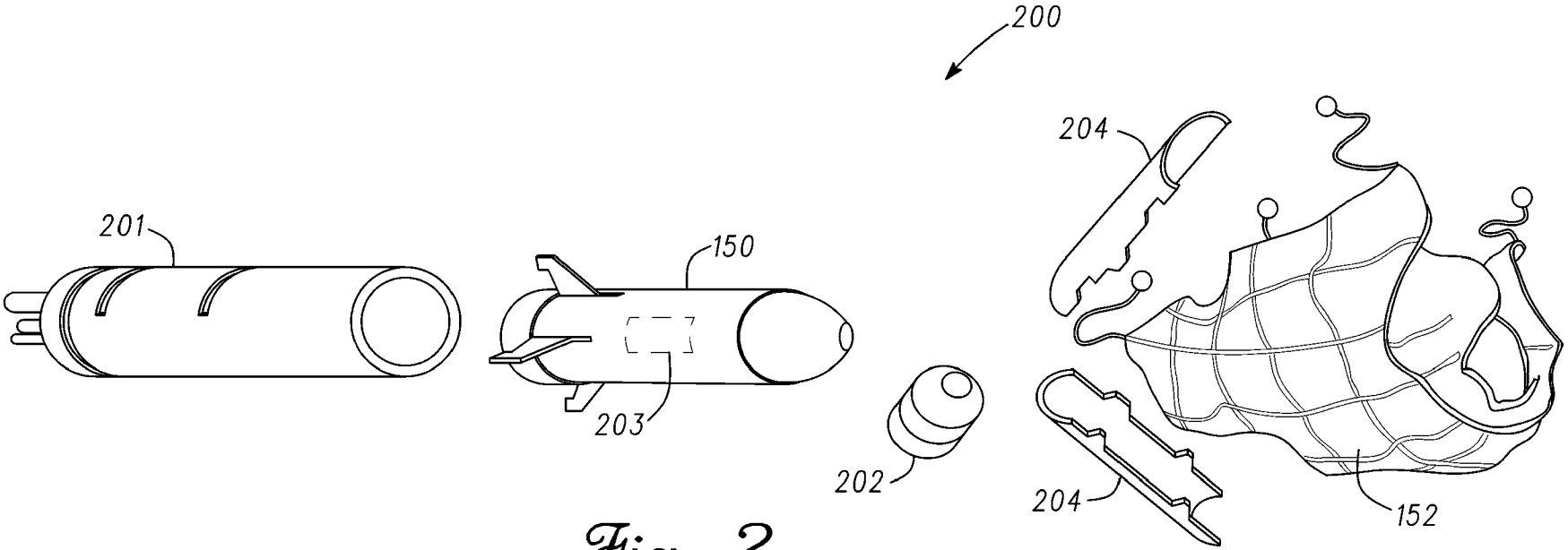
FIG. 2 depicts an entrapment system, in accordance with one embodiment, configured to contain projectiles from an explosion of an explosive device carried by a person.

FIG. 2 depicts an entrapment system 200, in accordance with one embodiment, configured to contain projectiles from an explosion of an explosive device carried by a person. As depicted, the entrapment system 200 includes a sabot 201 and an entrapment apparatus 150. In this embodiment, the entrapment apparatus 150 includes a casing 204 and a piece of multilayered fabric 152 packed into the casing 204. Additionally, the entrapment apparatus 150 may include a proximity sensor 202 coupled to the casing 204, a pyrotechnic device (not shown) coupled to the casing 204, and circuitry 203 configured to trigger the pyrotechnic device.

A "proximity sensor," such as the proximity sensor 202, refers to a variety of sensors that can detect the presence of objects. As an example, the proximity sensor 202 can be configured to detect the presence of a person at a particular distance. The proximity sensor 202 can detect a person or distance to the person by emitting an electromagnetic field or a beam of electromagnetic radiation (e.g., infrared and radar), and detecting changes in the field or return signal. The proximity sensor 202 is coupled to the casing 204 and, in this example, may be located at a front end or nose of the entrapment apparatus 150. Upon detection of a presence of a person at a predefined distance to that person, the proximity sensor 202 transmits a signal to a circuitry 203, which is electrically coupled to the proximity sensor 202 and the pyrotechnic device, that is configured to trigger the pyrotechnic device to explode. Examples of the circuitry 203 include an Application Specific Integrated Circuit (ASIC), a processor, a programmable logic device (e.g., a field-programmable gate array), and other circuitries. As illustrated in FIG. 2, the explosion of the pyrotechnic device breaks apart or opens the casing 204 in order to deploy the piece of multilayered fabric 152, as will be explained in more detail below.

The entrapment apparatus 150 is coupled to the sabot 201. As used herein, a "sabot," such as the sabot 201, refers to a device included in the entrapment system 200 that is used to launch, fire, or eject the entrapment apparatus 150. In one embodiment, the sabot 201 may be in the form of a tube with openings at both ends. In another embodiment, as depicted in FIG. 2, the sabot 201 may be a cup sabot, which is a device that surrounds the base and sides of the entrapment apparatus 150. In yet another embodiment, the sabot 201 may be a spindle sabot, which includes a set of matched rings having a center section in contact with the entrapment apparatus 150. As explained in more detail below, a sighting device (not shown) may additionally be coupled to the sabot 201, consistent with an alternative embodiment of the entrapment system 200.

Depending on the design and type of sabot 201, the entrapment apparatus 150 can be coupled to it in a variety of different ways. In the example of a cup sabot, the entrapment apparatus 150 may be fitted within the cup sabot. In another example, the entrapment apparatus 150 may be mounted on top of the sabot 201.

The sabot 201 can eject the entrapment apparatus 150 using a variety of different ejection mechanisms. In one embodiment, the ejection can be in the form of a propulsion system derived from commercial airbag technology. Such a propulsion pressure is funneled to the sabot 201 and the energy is transferred to the entrapment apparatus 150, thereby ejecting the entrapment apparatus 150 from the sabot 201. In an alternate embodiment, the ejection can be in the form of a booster charge that comprises gunpowder or other explosives.

Figure 3:
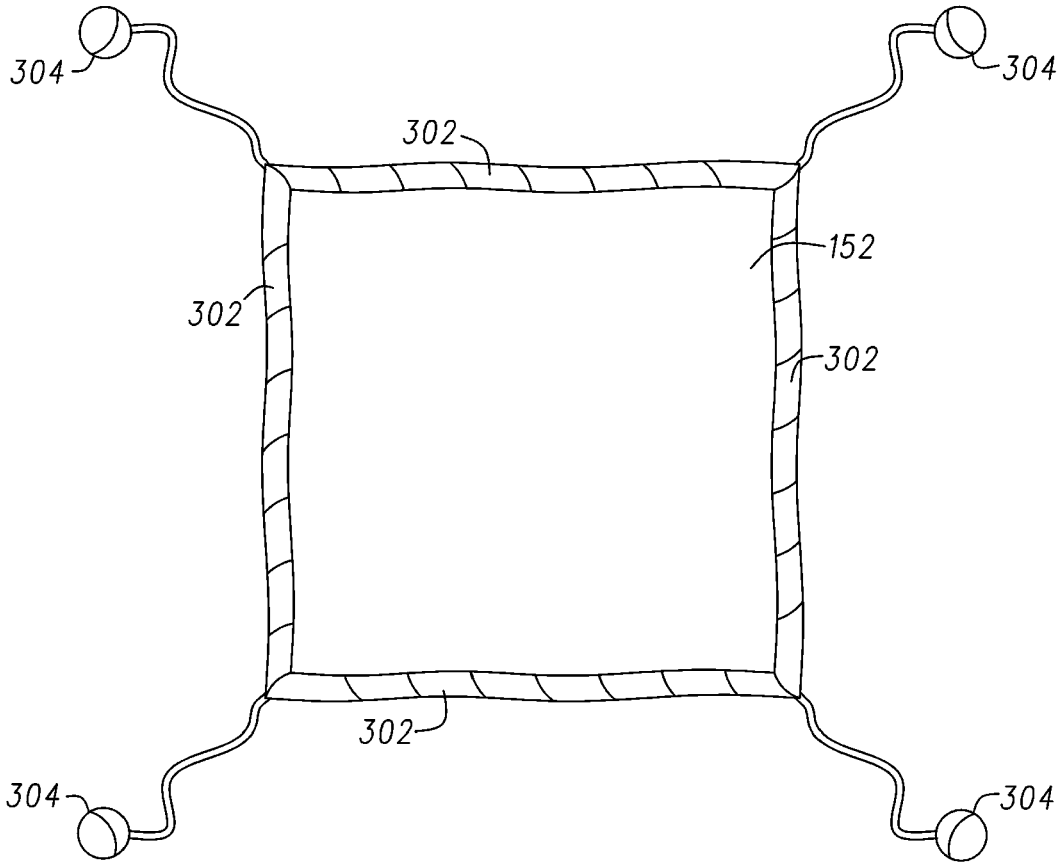
FIG. 3 depicts an embodiment of a piece of multilayered fabric that, when deployed, is configured to wrap around a person.

FIG. 3 depicts an embodiment of a piece of multilayered fabric 152 that, when deployed, is configured to wrap around a person. In one embodiment, the piece of multilayered fabric 152 may include an air beam structure 302 and bolas 304 may be attached or coupled to the piece of multilayered fabric 152. In the embodiment depicted in FIG. 3, the piece of multilayered fabric 152 is rectangular in shape. However, the shape and sizing of the piece of multilayered fabric 152 may be configured to optimize flight characteristics and/or protective performance of the material within launch mass limitations. For example, in other embodiments, the piece of multilayered fabric 152 may be in a variety of different shapes, such as triangular shapes, oval shapes, circular shapes, and other shapes. A size of the piece of multilayered fabric 152 may, for example, be about 1.6 $m^2$, which is sufficiently large enough to wrap around an adult's torso. As used herein, the term "about" means that the specified dimension or parameter may be varied within an acceptable manufacturing tolerance for a given application. In some embodiments, the acceptable manufacturing tolerance is ±10%.

The bolas 304 are weights tied or coupled to the piece of multilayered fabric 152. The bolas 304 may have a variety of different shapes and sizes. As an example, the bolas 304 may be rubber balls. It should be appreciated that any suitable number of bolas 304 may be coupled to the piece of multilayered fabric 152. In the embodiment depicted in FIG. 3, four bolas 304 are coupled to the piece of multilayered fabric 152. However, other embodiments may include fewer or more number of bolas 304.

The air beam structure 302 serves as a rigid structural support when inflated but is soft and pliable when deflated. The air beam structure 302 can be a part of or attached to the piece of multilayered fabric 152. In one example, the air beam structure 302 may be composed of a dimensionally stable fabric sleeve and an air-holding inner bladder. In another example, the air beam structure 302 may be composed of a coated fabric that is cut and manufactured to its intended shape. This air beam structure 302 is configured to unfold or stretch out the piece of multilayered fabric 152 after the casing of the entrapment apparatus is broken apart. The air beam structure 302 stiffens when inflated, and the stiffening stretches out the piece of multilayered fabric 152, which is initially packed into the entrapment apparatus. In one embodiment, the air beam structure 302 may include one or more bust panels to release excess pressure from the inflation.

The air beam structure 302 may also be in a variety of different shapes and sizes. In the embodiment depicted in FIG. 3, the air beam structure 302 is in the shape of a frame that borders the piece of multilayered fabric 152. In another embodiment, the air beam structure 302 may be two elongated, tubular structures that are coupled to the piece of multilayered fabric 152 in parallel. In yet another embodiment, the two elongated, tubular structures may be arranged in the form of an "X" shape where the center of this shape is located at the center of the piece of multilayered fabric 152.

It should be noted that a variety of different devices may be used to inflate the air beam structure 302. As an example, a gas generator (not shown) that is configured to dispense gas (e.g., a $CO_2$ cartridge) may be used to inflate the air beam structure 302. In one embodiment, the gas generator may be directly coupled to or attached to the piece of multilayered fabric 152. In another embodiment, the gas generator may be coupled to the air beam structure 302. In yet another embodiment, one or more bolas 304 may include or house gas generators. The lines that attach the piece of multilayered fabric 152 to the bolas 304 may be in the form of tubes that can transfer the gas from the gas generators in the bolas 304 to the air beam structure 302.

Figure 4:
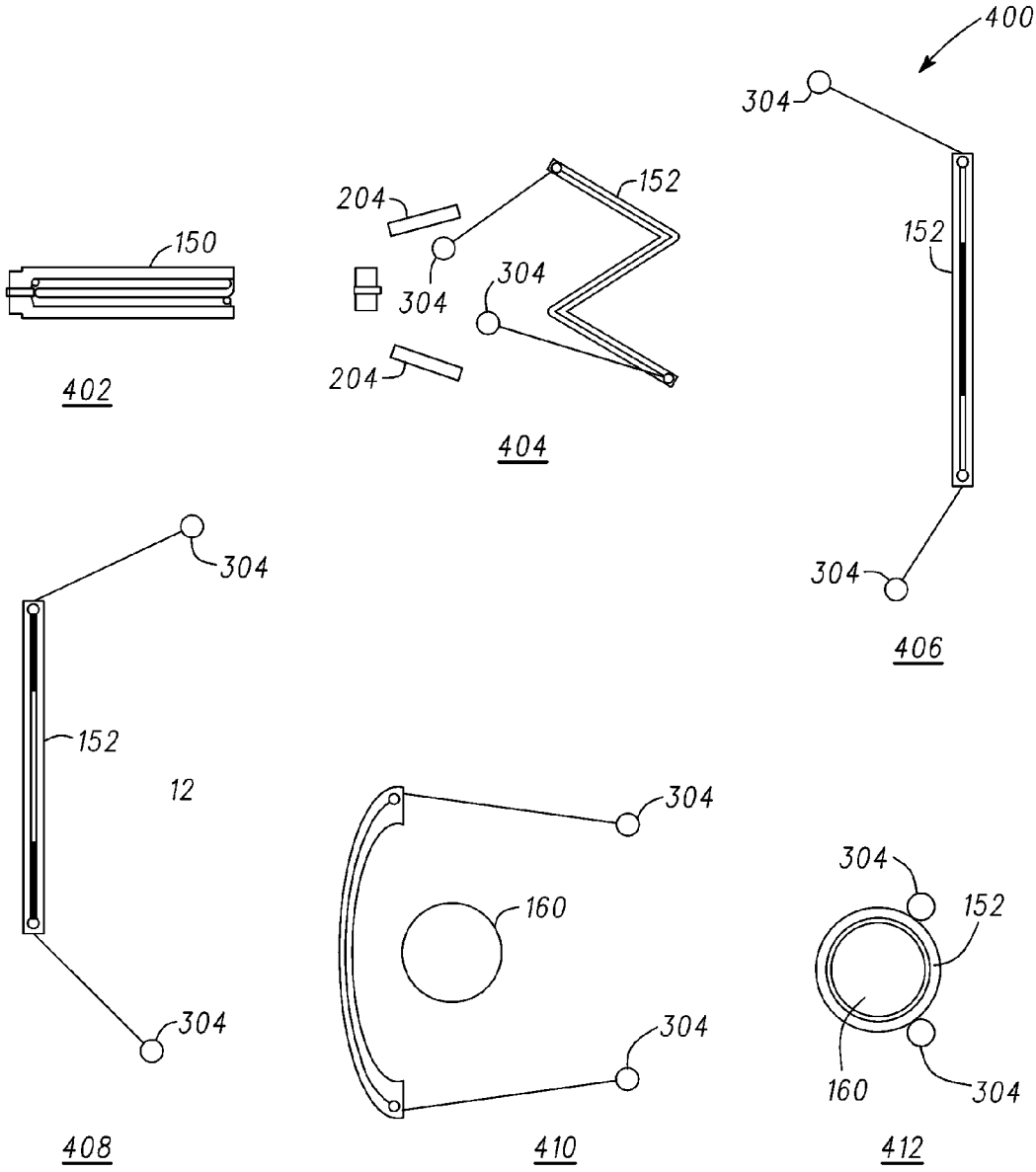
FIG. 4 depicts a diagram illustrating a deployment sequence of an entrapment apparatus.

FIG. 4 depicts a diagram illustrating a deployment sequence of an entrapment apparatus 150. As depicted at 402, the entrapment apparatus 150 is ejected from a sabot at a particular velocity. In one embodiment, the entrapment apparatus 150 is ejected at a sufficient velocity to maintain a planar trajectory for up to about 90 meters. Such a velocity may range from about 90 to 110 meters/second. In another embodiment, the entrapment apparatus 150 is ejected at a sufficient velocity to impart a residual energy that can knock down a person 160 carrying an explosive device upon impact of the piece of multilayered fabric 152. By knocking down the person 160, it may reduce casualties by redirecting the explosion from a direction parallel to the ground to another direction perpendicular to the ground. That is, knocking down the person 160 can redirect the explosion upwards. The residual energy that can knock down the person 160 may range, for example, between about 1000 joules and about 5000 joules.

After the entrapment apparatus 150 is ejected, a proximity sensor of the entrapment apparatus detects a presence of the person 160 and transmits signals to a circuitry included in the entrapment apparatus 150 identifying a distance to the person 160. Based on the signals received from the proximity sensor, the circuitry triggers an explosion of a pyrotechnic device at a predefined distance to the person 160. The explosion of the pyrotechnic device breaks apart the casing 204 to deploy the piece of multilayered fabric 152 packed into the entrapment apparatus 150. Upon release of the piece of multilayered fabric 152, a gas generator inflates the air beam structure to stretch out the piece of multilayered fabric 152, as depicted at 406 and 408.

As depicted at 410 and 412, burst panels in the air beam may be configured to purposely fail and release pressure in order to render the piece of multilayered fabric 152 to be sufficiently flexible to wrap around the person 160. The bolas 304 coupled to the piece of multilayered fabric 152 maintain sufficient inertia to wrap around and encircle the person 160 carrying the explosive device.

Figure 5:
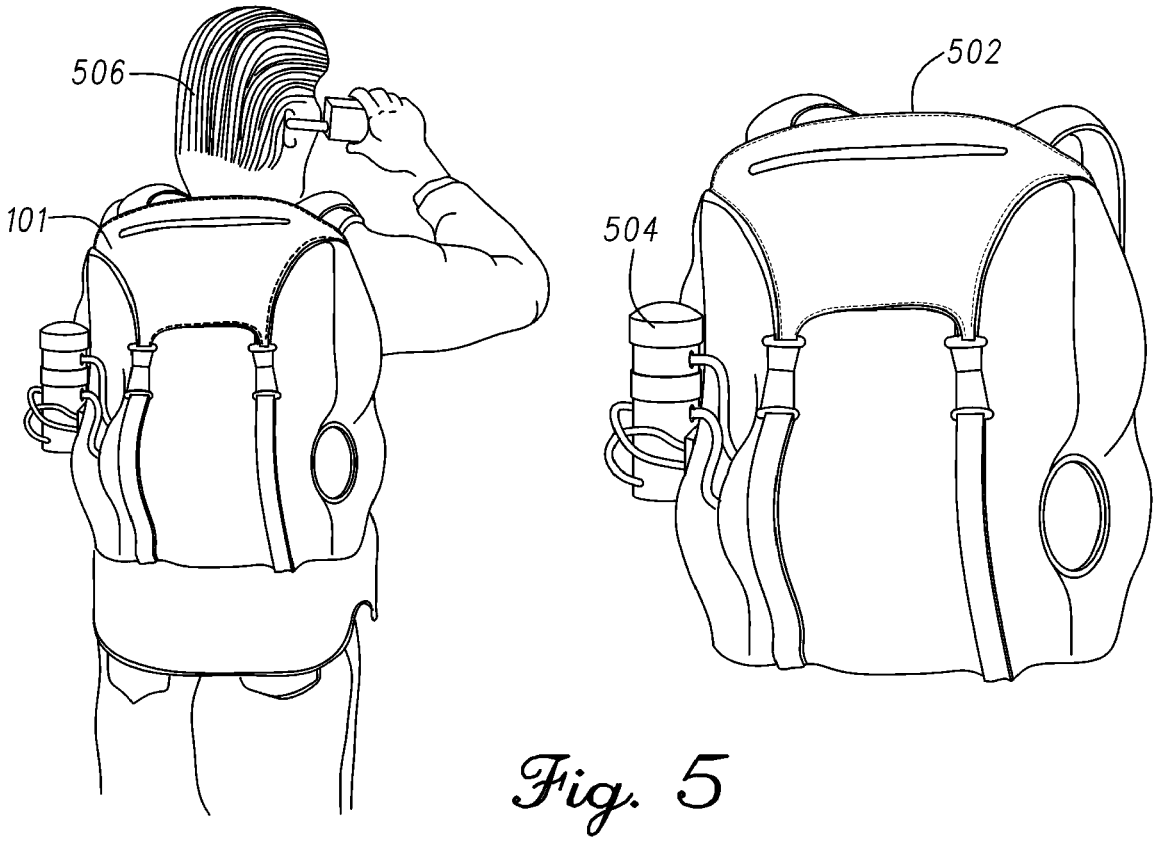
FIG. 5 depicts an embodiment of an entrapment system in the form of a rucksack delivery system.

FIG. 5 depicts an embodiment of an entrapment system in the form of a rucksack delivery system 502. The rucksack delivery system 502 may include an entrapment apparatus (not shown), a sabot (not shown), a sighting device (not shown), and a propulsion system 504. As depicted, the rucksack delivery system 502 may be carried by a person 101 who can place the entrapment apparatus at an appropriate location for deployment. As discussed above, the propulsion system 504 can, for example, be a derivative of commercial airbag technology. The propulsion system 504 funnels propulsion pressure to the sabot, and the entrapment apparatus is ejected from the sabot using the energy from the pressure transferred to the entrapment apparatus.

The sighting device may be coupled to the sabot and this sighting device is an optical device used to assist aiming by aligning an eye of the person 101 with the sabot or entrapment apparatus to be pointed. For example, the sighting device is configured to align the sabot relative to the person carrying the explosive device. Examples of sighting devices include iron sights, video cameras, laser sights, reflex sights, peep sights, telescopic sights, and other sighting devices.

In addition to the rucksack delivery system 502, it should be appreciated that an entrapment apparatus may be included in a variety of other entrapment systems. For example, in another embodiment, the entrapment system may be a handheld, shoulder-launched system where the sabot is in the form of a modified missile launch tube.

Figure 6:
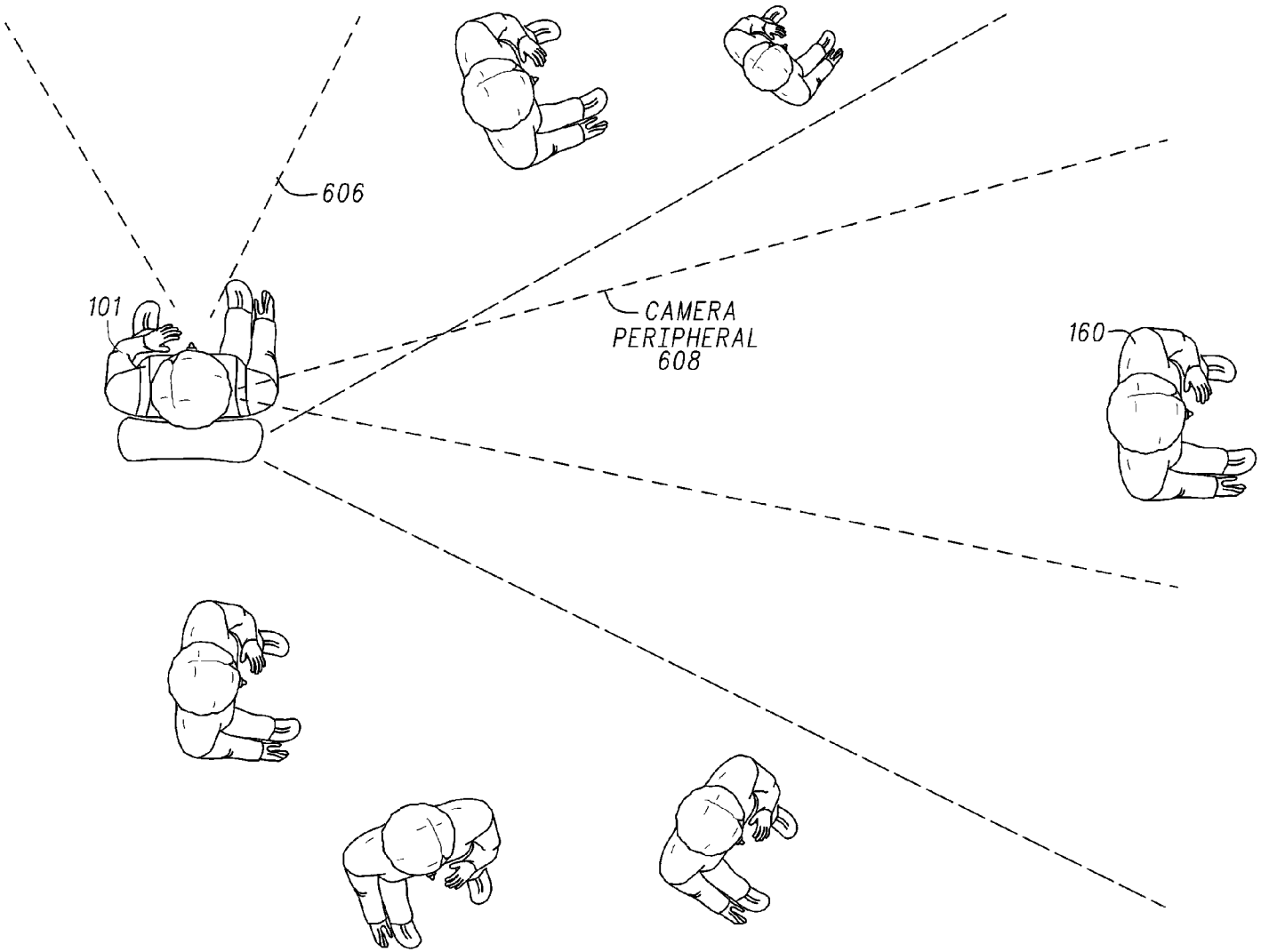
FIG. 6 depicts an example of a deployment of the rucksack delivery system to neutralize a person carrying an explosive device.

FIG. 6 depicts an example of a deployment of the rucksack delivery system to neutralize a person 160 carrying an explosive device. The person 101 carrying the rucksack delivery system initially identifies the person 160 carrying an explosive device. The identification of the person 160 can, for example, be made by surveillance identification or pre-notification of the threat. Upon identification, the person 101 carrying the rucksack delivery system can use a sighting device in the form of a targeting camera affixed 90° from the facial line of sight 606 and in-line with the direction of ejection of the entrapment apparatus. FIG. 6 depicts the camera peripheral 608 of the sighting device that the person 101 can acquire. Once the person 101 correctly aligns the sabot relative to the person 160 carrying the explosive device, the person 101 can launch the entrapment apparatus from the rucksack delivery system to neutralize the person 160 carrying the explosive device.

Figure 7A:
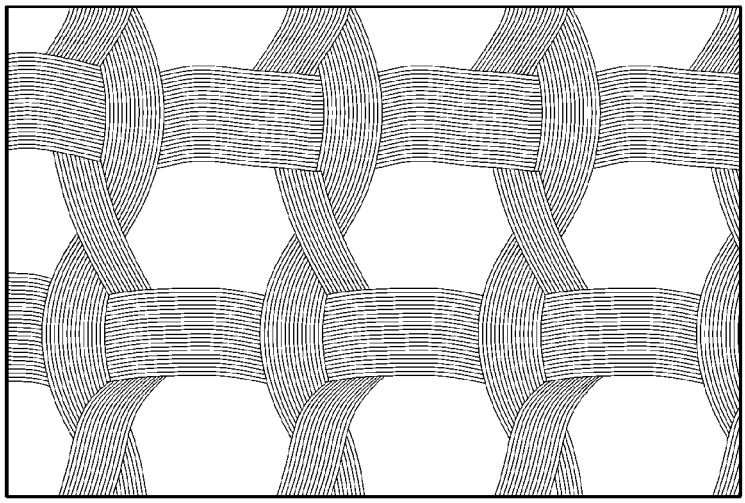
FIGS. 7A, 7B, and 7C depict magnified views of various pieces of multilayered fabrics, in accordance with some embodiments of the present invention.
Figure 7B:
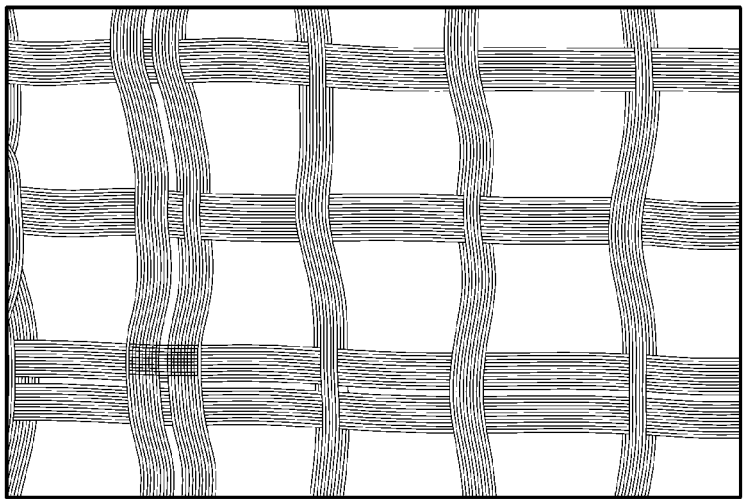
Figure 7C:
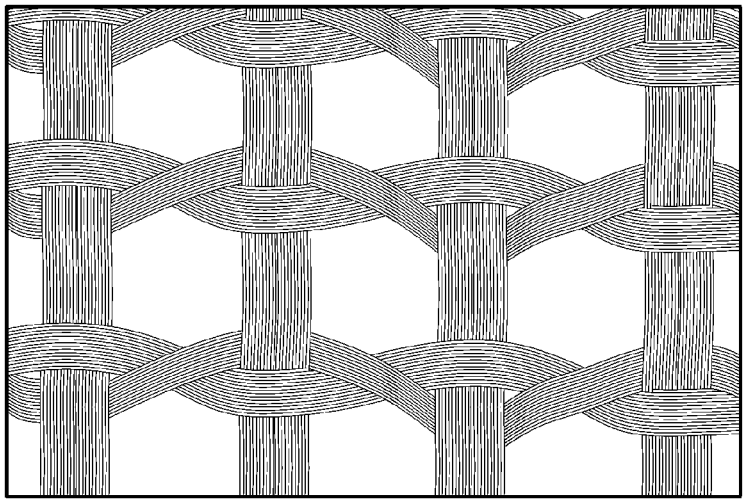

FIGS. 7A, 7B, and 7C depict magnified views of various pieces of multilayered fabrics, in accordance with some embodiments of the present invention. The pieces of multiplayer fabrics, in one embodiment, are configured to contain projectiles from an explosion, but allow the blast wave from the explosion to filter through. As discussed above, the projection of the projectiles from an explosion, and not the blast wave from the explosion, that usually inflicts the most casualties. For example, about 90% of the explosive energy is released as heat and pressure in the blast wave with only about 2% delivered as kinetic energy transferred to the projectiles.

To vent the blast wave, a piece of multilayered fabric, such as the pieces displayed in FIGS. 7A-7C, may be made from a mesh material that comprises openings, which are configured to vent the over pressure force resulting from the explosion. As a result, the piece of multilayered fabric can capture and contain projectiles, while the openings permit the over pressure to escape. In one embodiment, each opening in the piece of multilayered fabric has an open area that is between about 1 $mm^2$ and about 3 $mm^2$. For example, each opening may be greater than about 2 $mm^2$. The openings may be also expressed as an American Society for testing and materials (ASTM) permeability value where, for example, a piece of multilayered fabric may have a permeability value greater than about 600 Perms.

It should be appreciated that the piece of multilayered fabric comprises two or more layers of flexible, mesh like fabric. Each piece of fabric is layered on top of each other to form a single piece of multilayered fabric, and each piece of fabric can be made from a variety of different materials that are suitable to contain projectiles from an explosion. Examples of such materials include para-aramid fibers (e.g., KEVLAR), liquid crystal polymer fibers (e.g., VECTRA), ultra high molecular weight polyethylene (UHMWPE), polybenzoxazole (PBO) zylon, and other fiber of tenacity greater than, for example, about 10 g/denier. In one example embodiment, the piece of multilayered fabric comprises a high tenacity, low flammability para-aramid Leno mesh weighing about 6 oz/yd$^2$. The para-aramid fiber may be augmented with an additional layer of UHMWPE laminate to optimize, for example, mass for containing the projectiles. In another embodiment, the projectiles may be contained or captured with about 30 to 45 oz/yd$^2$ of material. The piece of multilayered fabric can be manufactured as plain woven, direct for reverse Leno, Leno looper, or warp knit constructions. In an embodiment, the primary yarn can be of 1500 denier para-aramid and the construction can be a leno double looper of 70 denier nylon. In a different embodiment, the primary yarn is 700 denier Liquid Crystalline Polymers (LCP) Polyester and the weave can be a direct Leno weave. In yet another embodiment, the primary yarn can be a 1300 denier UHMWPE yarn in a plain weave with a Kryton coating for stabilization.

In the foregoing detailed description, various features are occasionally grouped together in a single embodiment for the purpose of streamlining the disclosure. This method of disclosure is not to be interpreted as reflecting an intention that the claimed embodiments of the subject matter require more features than are expressly recited in each claim. Rather, as the following claims reflect, the embodiments of the invention may lie in less than all features of a single disclosed embodiment. Thus the following claims are hereby incorporated into the detailed description, with each claim standing on its own as a separate embodiment.

Plural instances may be provided for components, operations or structures described herein as a single instance. Finally, boundaries between various components, operations, and data stores are somewhat arbitrary, and particular operations are illustrated in the context of specific illustrative configurations. Other allocations of functionality are envisioned and may fall within the scope of embodiments of the invention(s). In general, structures and functionality presented as separate components in the exemplary configurations may be implemented as a combined structure or component. Similarly, structures and functionality presented as a single component may be implemented as separate components. These and other variations, modifications, additions, and improvements fall within the scope of embodiments of the invention(s).

What is claimed is:

1. An entrapment apparatus comprising:

a casing;

a piece of multilayered fabric packed into the casing, the piece of multilayered fabric, when deployed, configured to contain packed metal projectiles from an explosion of the explosive device; and at least one air beam frame including one or more air beam structures, and in a deployed configuration the at least one air beam frame extends across a portion of the multilayered fabric and the multilayered fabric is a web extending from the at least one air beam frame.

2. The entrapment apparatus of claim 1, further comprising a proximity sensor coupled to the casing, the proximity sensor configured to detect a presence of the person.

3. The entrapment apparatus of claim 2, further comprising:

a pyrotechnic device coupled to the casing; and a circuitry coupled to the proximity sensor and the pyrotechnic device, the circuitry configured to receive a signal from the proximity sensor and configured to trigger the pyrotechnic device to explode based on the signal, the explosion of the pyrotechnic device configured to break apart the casing.

4. The entrapment apparatus of claim 1, wherein the piece of multilayered fabric comprises a para-aramid fiber.

5. The entrapment apparatus of claim 1, wherein the piece of multilayered fabric comprises a liquid crystal polymer fiber.

6. The entrapment apparatus of claim 1, wherein the piece of multilayered fabric comprises an aromatic polymer.

7. The entrapment apparatus of claim 1, wherein the piece of multilayered fabric includes a plurality of openings sized and shaped to prevent the passage of explosive debris and permit the passage of explosive over pressure.

8. The entrapment apparatus of claim 1, wherein the at least one air beam frame extends around a perimeter of the piece of multilayered fabric with the web of the multilayered fabric positioned within the at least one air beam frame.

9. The entrapment apparatus of claim 1 comprising two or more bolas coupled with the piece of multilayered fabric near opposed ends of the piece of multilayered fabric.

10. The entrapment apparatus of claim 9, wherein at least one of the two or more bolas includes a gas generator configured to inflate the at least one air beam frame.

11. An entrapment apparatus comprising:

a casing;

a pyrotechnic device coupled to the casing;

a proximity sensor configured to detect a presence of a person;

a circuitry coupled to the pyrotechnic device and the proximity sensor, the circuitry configured to trigger the pyrotechnic device to explode based on a detection of the presence of the person, the explosion of the pyrotechnic device configured to break apart the casing;

a piece of multilayered fabric packed into the casing, the piece of multilayered fabric being a mesh, the piece of multilayered fabric, when stretched out, configured to wrap around the person having an explosive device and configured to contain packed metal projectiles from an explosion of the explosive device; and at least one air beam frame coupled with the piece of multilayered fabric, the air beam frame is inflatable from an undeployed configuration to a deployed configuration, and in the deployed configuration the at least one air beam frame provides a skeleton of one or more air beam structures that expand the multilayered fabric into a corresponding expanded configuration, and the piece of multilayered fabric is a web extending from the one or more air beam structures.

12. The entrapment apparatus of claim 11, further comprising a gas generator coupled to the piece of multilayered fabric, the gas generator configured to inflate the air beam structure, the inflation configured to stiffen the air beam structure to stretch out the piece of multilayered fabric.

13. The entrapment apparatus of claim 11, further comprising two or more bolas coupled near opposed ends of the piece of multilayered fabric.

14. The entrapment apparatus of claim 13, wherein at least one of the two or more bolas comprises a gas generator that is configured to inflate the air beam structure, the inflation configured to stiffen the air beam structure.

15. The entrapment apparatus of claim 11, wherein the mesh is comprises a plurality of openings that are configured to vent an overpressure force resulting from the explosion of the explosive device.

16. The entrapment apparatus of claim 15, wherein each opening of the plurality of openings has an open area that is greater than two square millimeters.

17. The entrapment apparatus of claim 15, wherein each opening of the plurality of openings has an open area that is between one square millimeters and three square millimeters.

18. The entrapment apparatus of claim 11, wherein the circuitry is configured to trigger the pyrotechnic device to explode based on the detection of the presence of the person at a predefined distance to the person.

19. The entrapment apparatus of claim 11, wherein the air beam frame extends around a perimeter of the multilayered fabric, and the multilayered fabric extends between opposed portions of the air beam frame in the expanded configuration.

* * * * *

UNITED STATES PATENT AND TRADEMARK OFFICE

CERTIFICATE OF CORRECTION

PATENT NO. : 8,186,276 B1
APPLICATION NO. : 12/556311
DATED : May 29, 2012
INVENTOR(S) : Olden et al.

It is certified that error appears in the above-identified patent and that said Letters Patent is hereby corrected as shown below:

On the title page

Item 56, under "U.S. Patent Documents", line 9, after "7,743,709 B2 6/2010 Kolnik et al.", insert --8,157,169 4/2012 Olden et al.--, therefor Item 56, in column 2, under "Other Publications", line 1, before "Application", insert --International--, therefor On page 2, item 56, column 2, under "Other Publications", line 3-4, after ""International Application Serial No. PCT/US2010/02849, International Search Report mailed Aug. 5, 2011", 2 pgs.", delete ""International Serial No. PCT/US2010/000629, Search Report mailed May 13, 2010", 5 pgs.", therefor On page 2, item 56, column 2, under "Other Publications", line 9, delete "12/610,498 ," and insert --12/610,498,--, therefor On page 2, item 56, column 2, under "Other Publications", line 13, after ""U.S. Appl. No. 12/610,498, Non Final Office Action mailed Nov. 7, 2011", 8 pgs,", insert --"U.S. Appl. No. 12/610,498, Notice of Allowance mailed Feb. 10, 2012", 9 pgs.--, therefor In the specification In column 3, line 39, delete ""proximity sensor,"" and insert --"proximity sensor"--, therefor Signed and Sealed this
Twelfth Day of July, 2016

Michelle K. Lee

Michelle K. Lee
*Director of the United States Patent and Trademark Office*